US007265731B2

(12) United States Patent
Vance et al.

(10) Patent No.: US 7,265,731 B2
(45) Date of Patent: Sep. 4, 2007

(54) METHOD AND APPARATUS FOR IMPROVING THE PERFORMANCE OF A MULTI-BAND ANTENNA IN A WIRELESS TERMINAL

(75) Inventors: Scott LaDell Vance, Cary, NC (US); Bruce Wilcox, Cary, NC (US)

(73) Assignee: Sony Ericsson Mobile Communications AB (SE)

( * ) Notice: Subject to any disclaimer, the term of this patent is extended or adjusted under 35 U.S.C. 154(b) by 41 days.

(21) Appl. No.: 11/025,459

(22) Filed: Dec. 29, 2004

(65) Prior Publication Data

US 2006/0139211 A1 Jun. 29, 2006

(51) Int. Cl.
*H01Q 1/50* (2006.01)

(52) U.S. Cl. ..... 343/860; 343/850; 333/32

(58) Field of Classification Search ..... 343/860, 343/702, 850; 333/32
See application file for complete search history.

(56) References Cited

U.S. PATENT DOCUMENTS 5,087,922 A * 2/1992 Tang et al. ..... 343/814
6,518,922 B1 2/2003 Hoffmeister
6,873,293 B2 * 3/2005 Proctor et al. ..... 343/702
6,930,640 B2 * 8/2005 Chung et al. ..... 343/700 MS
2003/0174092 A1 9/2003 Sullivan
2004/0132487 A1 * 7/2004 Kearns ..... 455/552.1

FOREIGN PATENT DOCUMENTS

EP 0993070 4/2000
WO WO 03/094289 11/2003
WO WO 03/096474 11/2003

OTHER PUBLICATIONS

PCT International Search Report, International Application No. PCT/US2005/023093, mailed Oct. 18, 2005.

* cited by examiner

*Primary Examiner*—Tho Phan
(74) *Attorney, Agent, or Firm*—Coats & Bennett, P.L.L.C.

(57) ABSTRACT

A method and apparatus for improving the efficiency of a multi-band antenna in a wireless terminal over a wide range of frequencies is described herein. To compensate for the undesirable coupling that occurs in a low frequency band between a parasitic antenna and a primary antenna in certain designs, a matching network is connected to at least one ground port of the multi-band antenna. The matching network controls the multi-band antenna performance based on the current transmission frequency band. In some embodiments, the matching network is configured to operate as an open circuit when multi-band antenna operates in the low frequency band, and to operate as a short circuit when multi-band antenna operates in the high frequency band.

17 Claims, 5 Drawing Sheets

METHOD AND APPARATUS FOR IMPROVING THE PERFORMANCE OF A MULTI-BAND ANTENNA IN A WIRELESS TERMINAL

BACKGROUND OF THE INVENTION

The present invention relates generally to multi-band antennas in wireless terminals, and more particularly to improving the performance of the multi-band antenna using a frequency band specific matching network.

Conventional wireless terminals typically include multi-band antenna systems that enable the wireless terminal to operate in multiple frequency bands. An exemplary multi-band antenna system may operate in a GSM band (824-894 MHz), an EGSM band (880-960 MHz), a PCS band (1850-1990 MHz) and/or a DCS band (1710-1880 MHz). Typically, a primary antenna of the multi-band antenna operates in two frequency bands—a low frequency band and a high frequency band.

When additional or wider frequency bands of operation are desired, the antenna system may further include a parasitic antenna element to expand the bandwidth of either the high or the low frequency bands or to add a third, separate frequency band. For example, a multi-band antenna with a primary antenna configured to operate in both the GSM and the PCS bands often includes a parasitic antenna tuned to the DCS frequency band. In this example, the parasitic antenna capacitively couples to the primary antenna. As a result, the parasitic antenna expands the bandwidth of the high frequency band to include both PCS and DCS frequencies. However, while the parasitic antenna generally expands the bandwidth of the high frequency band, the proximity of the parasitic antenna to the low frequency portion of the primary antenna may reduce the bandwidth of the low frequency band, and may also reduce the gain of the multi-band antenna system in the low frequency band.

SUMMARY OF THE INVENTION

The present invention comprises a method and apparatus that improves the efficiency of a multi-band antenna system over a wide range of transmission frequencies. According to the present invention, a matching network connected to a ground port of a multi-band antenna controls the impedance of the multi-band antenna based on a current transmission frequency band. In one embodiment, the matching network operates as an open circuit when the antenna operates in a first frequency band, and operates as a short circuit when the antenna operates in a second frequency band.

DETAILED DESCRIPTION OF THE INVENTION

Figure 1:
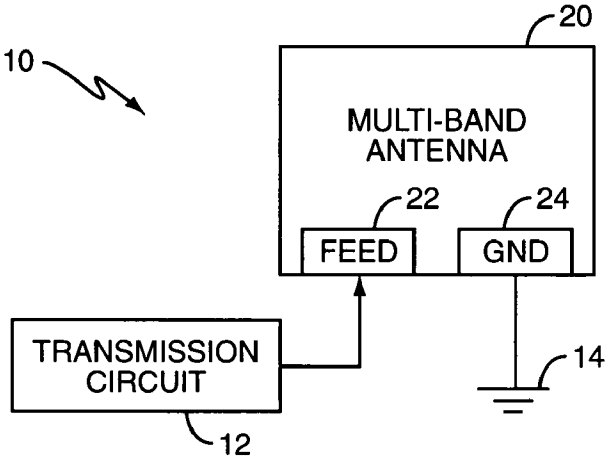
FIG. 1 PRIOR ART
FIG. 1 illustrates a block diagram of a conventional multi-band antenna system.

A conventional multi-band antenna system 10, illustrated in FIG. 1, includes a transmission circuit 12, at least one ground 14, and a multi-band antenna 20. The multi-band antenna 20 includes a feed port 22 and at least one ground port 24, where transmission circuit 12 connects to the feed port 22 and ground 14 connects to the ground port 24. Typically, multi-band antenna 20 is designed to operate in at least two frequency bands—a high frequency band and a low frequency band. Exemplary frequency bands include:

| Name | Acronym | Low Frequency Limit (MHz) | High Frequency Limit (MHz) |
|---|---|---|---|
| Global System for Mobile communications | GSM | 824 | 894 |
| Enhanced GSM | EGSM | 880 | 960 |
| Digital Cellular System | DCS | 1710 | 1880 |
| Personal Communications Service | PCS | 1850 | 1990 |

As used herein, the terms "high frequency band" and "low frequency band" simply refer to different frequency bands, where one frequency band is higher/lower than the other. As such, the terms "high frequency band" and "low frequency band" are not limited to any particular transmission frequency band.

Figure 2:
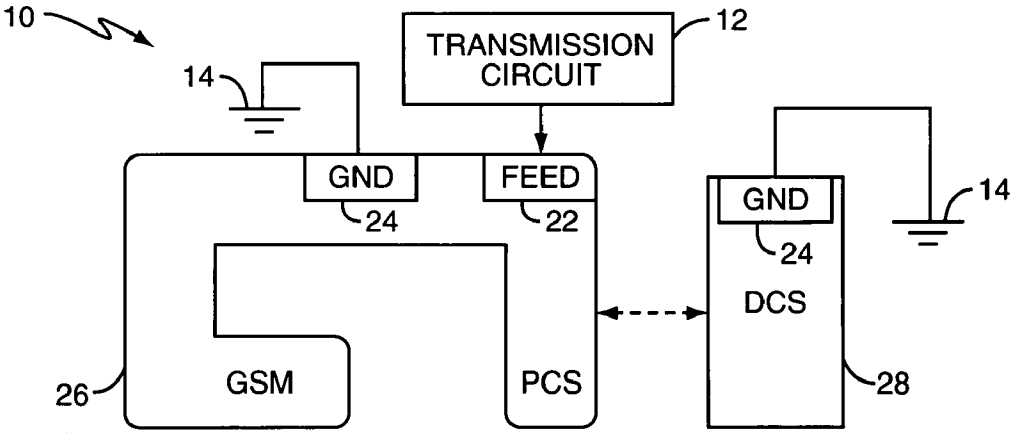
FIG. 2 PRIOR ART
FIG. 2 illustrates one exemplary multi-band antenna for the multi-band antenna of FIG. 1.

As well understood in the art, multi-band antenna 20 includes a primary antenna 26 configured to operate in two frequency bands. For example, as shown in FIG. 2, primary antenna 26 may be configured to operate in the GSM band (a low frequency band) and the PCS band (a high frequency band). The dashed line in FIG. 4A plots the VSWR (Voltage Square Wave Ratio) across a wide range of frequencies on a rectangular coordinate system for the primary antenna 26.

Figure 3:
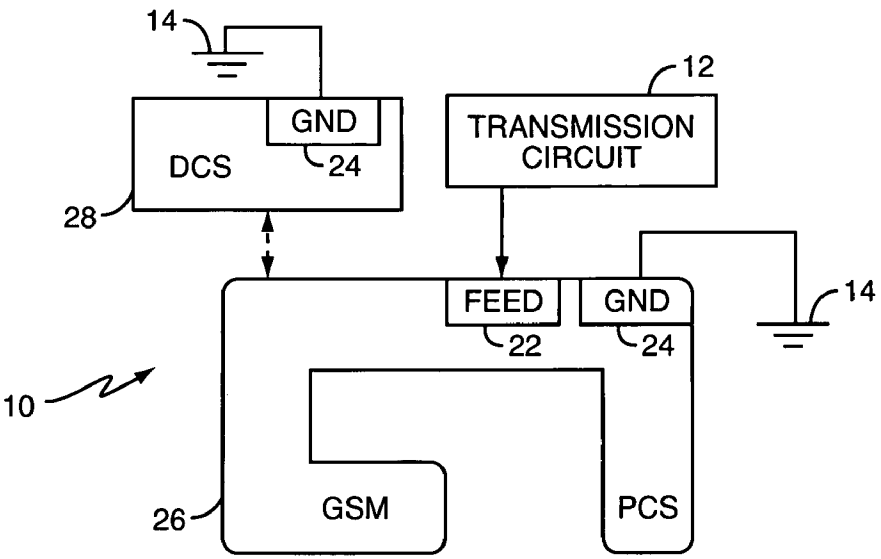
FIG. 3 PRIOR ART
FIG. 3 illustrates another exemplary multi-band antenna for the multi-band antenna system of FIG. 1.
Figure 4:
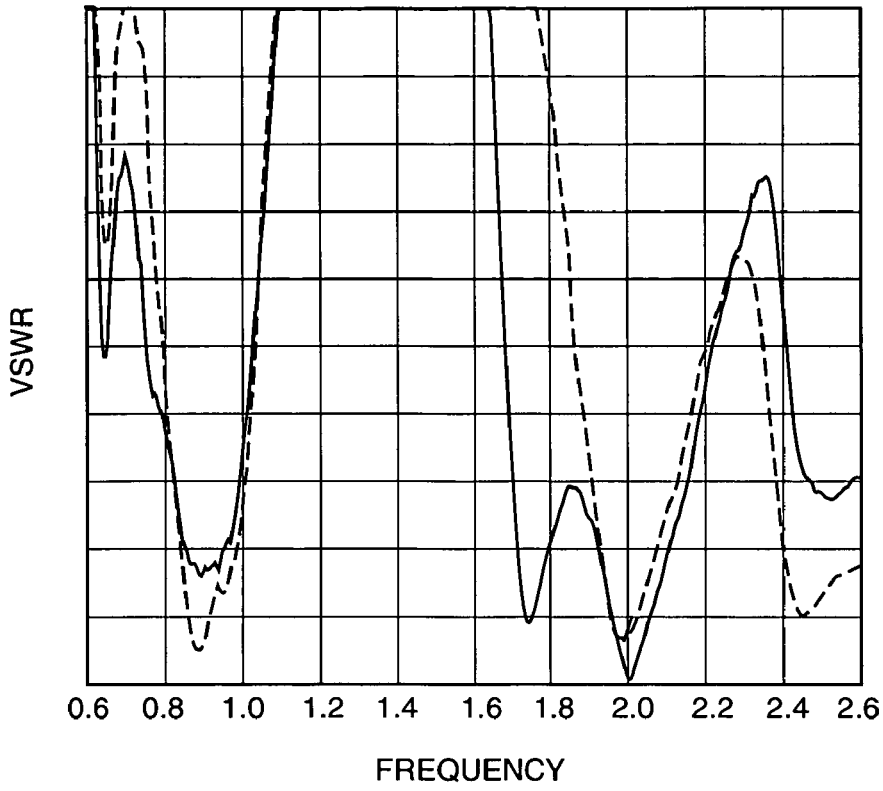
FIG. 4 PRIOR ART
FIG. 4 illustrates the VSWR of the multi-band antenna of FIG. 2.

In some instances, it may be desirable to expand one of the transmission frequency bands and/or to operate in a third frequency band. To that end, multi-band antenna 20 may also include a parasitic antenna 28 configured to operate, e.g., in the DCS frequency band. As shown in FIG. 2, parasitic antenna 28 may be positioned proximate the PCS "leg" of primary antenna 26. Alternatively, parasitic antenna 28 may be positioned along a top portion of primary antenna 26, proximate the GSM "leg," as shown in FIG. 3. In any event, parasitic antenna 28 resonates with primary antenna 26 to form a second, DCS high frequency band. As shown by the solid line in the plot of FIG. 4, this results in a wider high frequency band that encompasses both the PCS and DCS frequency bands. However, because parasitic antenna 28 is positioned physically close to the low-band element of primary antenna 26, the parasitic antenna 28 also interferes with the operation of the primary antenna 26 in the low frequency band. As shown in FIG. 4, parasitic antenna 28 undesirably alters the impedance of multi-band antenna 20 in the low frequency band. This results in a narrower bandwidth and an overall reduction in antenna gain in the low frequency band, as shown by the solid line in FIG. 4.

To address this problem, the present invention controls an impedance associated with a ground port of a multi-band antenna based on the current transmission frequency band. As a result, the present invention may control the frequency dependent coupling between the parasitic antenna and the primary antenna.

Figure 5:
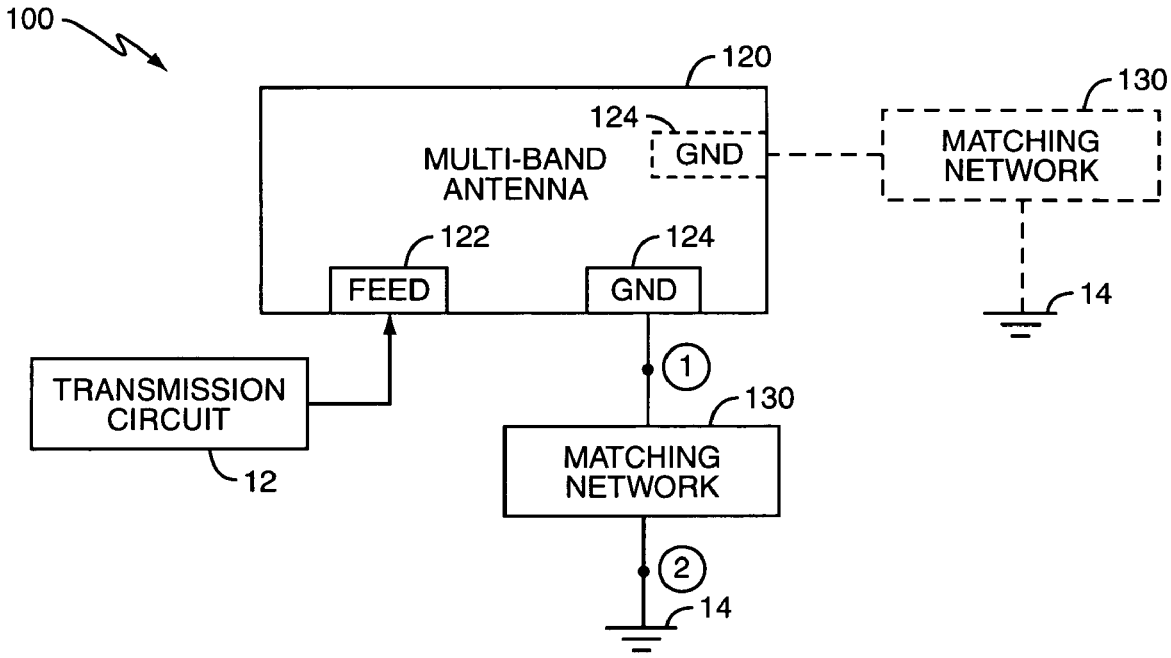
FIG. 5 illustrates a block diagram of an exemplary multi-band antenna system according to the present invention.

FIG. 5 illustrates a block diagram of one exemplary multi-band antenna system 100 that addresses the above-referenced problems. As shown in FIG. 5, multi-band antenna system 100 includes a multi-band antenna 120 having a feed port 122 and at least one ground port 124, a transmission circuit 12 connected to the feed port 122, at least one ground 14, and at least one matching network 130 connected between ground port 124 and ground 14. Matching network 130 controls the impedance of the multi-band antenna 120 based on the transmission frequency band. For example, by configuring the matching network 130 to have an impedance $Z_1$ in a first frequency band and an impedance $Z_2$ in a second frequency band, matching network 130 controls an impedance of the multi-band antenna 120 over a desired range of frequencies.

Figure 6A:
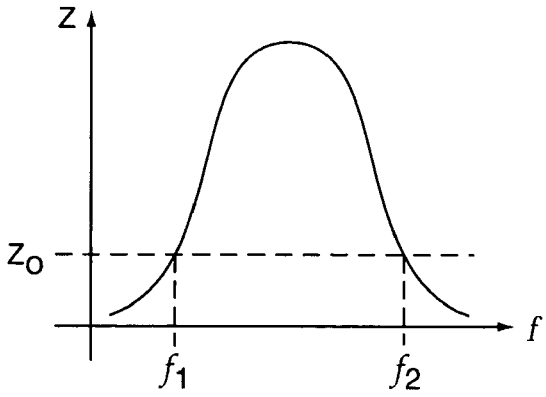
FIGS. 6A and 6B graphically illustrates the definition of open and short circuit, respectively, as used herein.
Figure 6B:
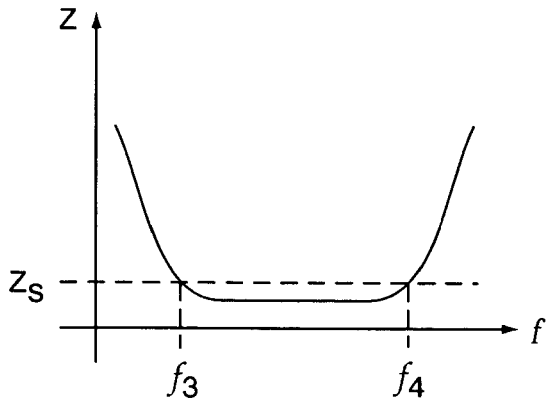
Figure 7:
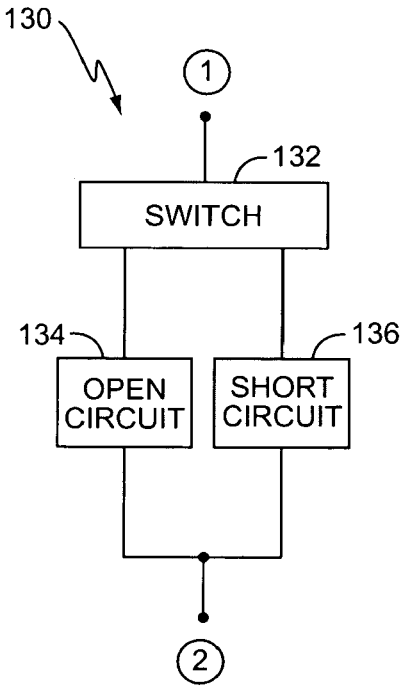
FIG. 7 illustrates a block diagram of one exemplary matching network for the multi-band antenna system of FIG. 5.

Matching network 130 may be any type of matching network that controls the impedance based on a current transmission frequency band. For example, FIG. 7 illustrates one exemplary matching network 130 according to the present invention. In this embodiment, matching network 130 comprises a switch 132, open circuit path 134, and a short circuit path 136 connected between points 1 and 2 of the multi-band antenna system 100 of FIG. 5. Open circuit path 134 comprises a circuit designed to operate as an open circuit, and short circuit path 136 comprises a circuit designed to operate as a short circuit. As used herein, operating as a "short circuit" in a particular frequency band is defined as having an impedance $Z_1$ less than or equal to a short circuit impedance $Z_s$ ($Z_1 \leqq Z_s$) for $f_3 \leqq f \leqq f_4$, as shown in FIG. 6B. The short circuit impedance $Z_s$ may be any selected impedance. For example, $Z_s$ may be any value less than or equal to 20 Ω, where $Z_s$ typically equals less than 2 Ω. Further, as used herein, operating as an "open circuit" in a particular frequency band is defined as having an impedance $Z_2$ greater than or equal to an open circuit impedance $Z_o$ ($Z_2 \geqq Z_o$) for $f_1 \leqq f \leqq f_2$, as shown in FIG. 6A. The open circuit impedance $Z_o$ may be any selected impedance. For example, $Z_o$ may be any value greater than or equal to 50 Ω, where $Z_o$ typically equals approximately 200 Ω.

A controller (not shown) controls switch 132 to selectively connect point 1 to either the open circuit path 134 or to the short circuit path 136 based on the current transmission frequency band. For example, the controller may control switch 132 to connect point 1 to the open circuit path 134 when multi-band antenna 120 operates in a low frequency band, such as a GSM band. Alternatively, the controller may control switch 132 to connect point 1 to the short circuit path 136 when multi-band antenna 120 operates in a high frequency band, such as a PCS and/or DCS band. It will be appreciated that in an alternate implementation, the controller may control switch 132 to connect point 1 to the short circuit path 136 or the open circuit path 134 when the multi-band antenna 120 operates in a low frequency band or a high frequency band, respectively. Further, while FIG. 7 illustrates an open circuit path 134 and a short circuit path 136, paths 134 and 136 may alternatively be designed to have any desired impedance.

Figure 8:
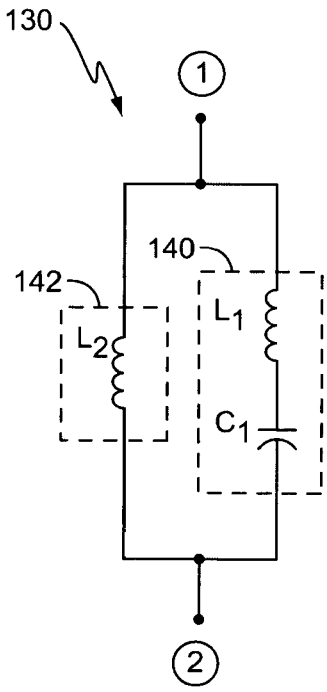
FIG. 8 illustrates a block diagram of another exemplary matching network for the multi-band antenna system of FIG. 5.

FIG. 8 illustrates a block diagram for another exemplary matching network 130 according to the present invention. As shown in FIG. 8, matching network 130 comprises a parallel passive circuit having an inductor circuit 142 in parallel with a series inductor-capacitor (LC) circuit 140. In the matching network 130 of FIG. 8, series LC circuit 140 is tuned based on high frequency band requirements, and $C_1$ and $L_2$ are tuned based on low frequency band requirements. In FIG. 8, circuit elements $L_1$, $L_2$, and $C_2$ are shown for illustrative purposes only and do not indicate or imply that matching network 130 comprises only two inductors and a single capacitor.

In any event, the designer selects the values for $L_1$, $L_2$, and $C_1$ based on a desired impedance for a particular transmission frequency band. For example, $L_1$, $L_2$, and $C_1$ may be selected so that matching network 130 operates as an open circuit for a low frequency band, such as a GSM and/or EGSM band, and operates as a short circuit for a high frequency band, a such as PCS and/or DCS band.

While there may be several ways to determine the appropriate values for the passive circuit of FIG. 8, the following mathematical analysis illustrates one exemplary method for determining the inductor and capacitor values for matching network 130. Equation (1) represents the impedance of the matching network 130 of FIG. 8, where ω represents the frequency in radians.

$$Z(j\omega) = \frac{j\omega L_2(1-\omega^2 L_1 C_1)}{1-(\omega^2 L_1 C_1 + \omega^2 L_2 C_1)} \tag{1}$$

As discussed above, $C_1$ and $L_1$ are selected based on the high band frequency requirements, while $C_1$ and $L_2$ are selected based on the low band frequency requirements. Further, an optimum series resonance frequency, $\omega_{o,s}$, which represents the geometric mean of the low band frequency limit, may be defined by:

$$\omega_{o,s}=\sqrt{\omega_{l1}\cdot\omega_{l2}} \tag{2}$$

while the parallel resonance frequency, $\omega_{o,p}$, which represents the geometric mean of the high band frequency limit, may be defined by:

$$\omega_{o,p}=\sqrt{\omega_{h1}\cdot\omega_{h2}}. \tag{3}$$

For the following analysis, $\omega_{l1}$ and $\omega_{l2}$ represent the upper and lower boundary frequencies, respectively, of the low frequency band, while $\omega_{h1}$ and $\omega_{h2}$ represent the lower and upper boundary frequencies, respectively, of the high frequency band.

As well understood by those skilled in the art, series resonance occurs when the numerator of Equation (1) equals zero, which results in Equation (4).

$$1=\omega_{o,s}^2 L_1 C_1=\omega_{h1}\omega_{h2} L_1 C_1 \tag{4}$$

Further, parallel resonance occurs when the denominator of Equation (1) equals zero, which results in Equation (5).

$$1=\omega_{o,p}^2 L_1 C_1+\omega_{o,p}^2 L_2 C_1=\omega_{l1}\omega_{l2}(L_1 C_1+L_2 C_1) \tag{5}$$

As shown in the following analysis, Equations (4) and (5) may be used to determine the inductor and capacitor values for particular frequency bands of operation.

Assuming that the parallel resonance requirements dominate the component value determination, $L_2$ may be given by:

$$L_2 = \frac{Z_{goal}(j\omega_{l1}) \cdot \left(1 - \frac{\omega_{l1}^2}{\omega_{o,p}^2}\right)}{j\omega_{l1}}, \tag{6}$$

where $Z_{goal}(j\omega_{l1})$ represents the desired impedance for the low frequency band. After determining $L_2$, Equations (4) and (5) may be solved for $C_1$ and $L_1$, resulting in Equations (7) and (8).

$$C_1 = \frac{\omega_{o,s}^2 - \omega_{o,p}^2}{\omega_{o,s}^2 \cdot \omega_{o,p}^2 \cdot L_2} \tag{7}$$

$$L_1 = \frac{1}{\omega_{o,s}^2 \cdot C_1} \tag{8}$$

As shown above, by selecting a desired low band impedance and the boundary frequencies of the high and low frequency bands, $L_2$ may be calculated (Equation (6)). Subsequently, $C_1$ and $L_1$ may be calculated (Equations (7) and (8)). For example, when $\omega_1$=5.1773 Grad/sec, $Z_{goal}(\omega_1)$ =800 Ω, $\omega_{o,p}$=5.5883 Grad/sec, and $\omega_{o,s}$=11.59 Grad/sec, $L_2$=21.89 nH, $C_1$=1.12 pF, and $L_1$=6.63 nH.

It will be appreciated that the above analysis assumes a 50 Ω multi-band antenna system 100. As such, the values calculated by the above analysis will vary slightly for a 75 Ω or 100 Ω system, for example. However, the general approach illustrated by the above analysis still applies to non-50 Ω systems. Further, it will be appreciated that the above equations are based on ideal elements. As such, the above simply represents an exemplary design process for matching network 130.

Figure 9:
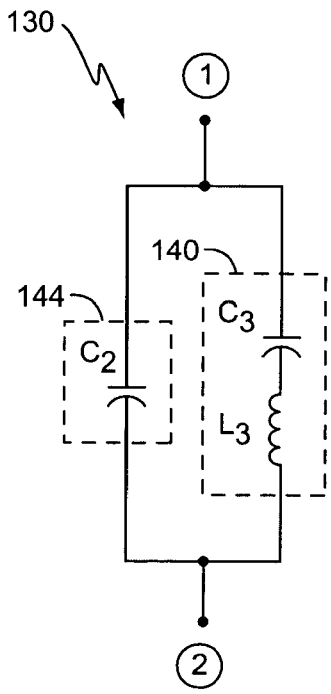
FIG. 9 illustrates a block diagram of another exemplary matching network for the multi-band antenna system of FIG. 5.

FIG. 9 illustrates a block diagram for still another exemplary matching network 130 designed to operate as a short circuit for low frequency bands and as an open circuit for high frequency bands. As shown in FIG. 9, matching network 130 comprises a parallel passive circuit having a capacitor circuit 144 in parallel with a series LC circuit 140. Similar to the process described above, the inductor and capacitor values, $C_2$, $C_3$, and $L_3$ are selected to provide a short circuit for frequencies in a low frequency band and to provide an open circuit for frequencies in a high frequency band. Exemplary values are: $C_2$=1 pF, $C_3$=3.6 pF, and $L_3$=10 nH.

It will be appreciated that the exemplary matching networks 130 illustrated in FIGS. 7-9 are for illustrative purposes only and therefore, are not intended to be limiting. As such, other matching networks 130 that provide desired impedances for different frequency bands may also be used without deviating from the teachings of the present invention.

Figure 10:
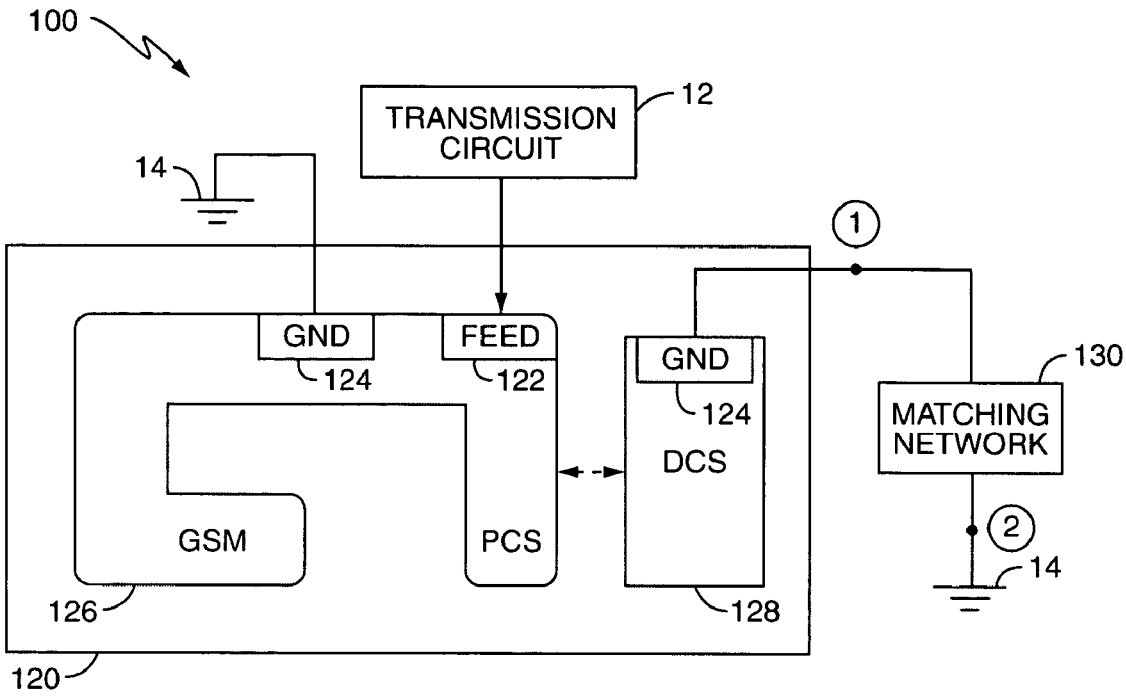
FIG. 10 illustrates an exemplary multi-band antenna with a matching network according to the present invention.

As discussed above, matching network 130 may be connected to any ground port 124 of multi-band antenna 130. For example, as illustrated in FIG. 10, matching network 130 may connect to a parasitic ground port 124 associated with parasitic antenna 128. To counter the negative coupling effects of the parasitic antenna 128 with primary antenna 126 associated with the low band transmission frequencies while also maintaining the desired coupling effects in the high frequency band, matching network 130 may operate as an open circuit for transmission frequencies in the low frequency band, and as a short circuit for transmission frequencies in the high frequency band, as described above. As a result, parasitic antenna 128 effectively couples with primary antenna 126 to widen the high frequency band without affecting the performance of the multi-band antenna 120 in the low frequency band.

Figure 11:
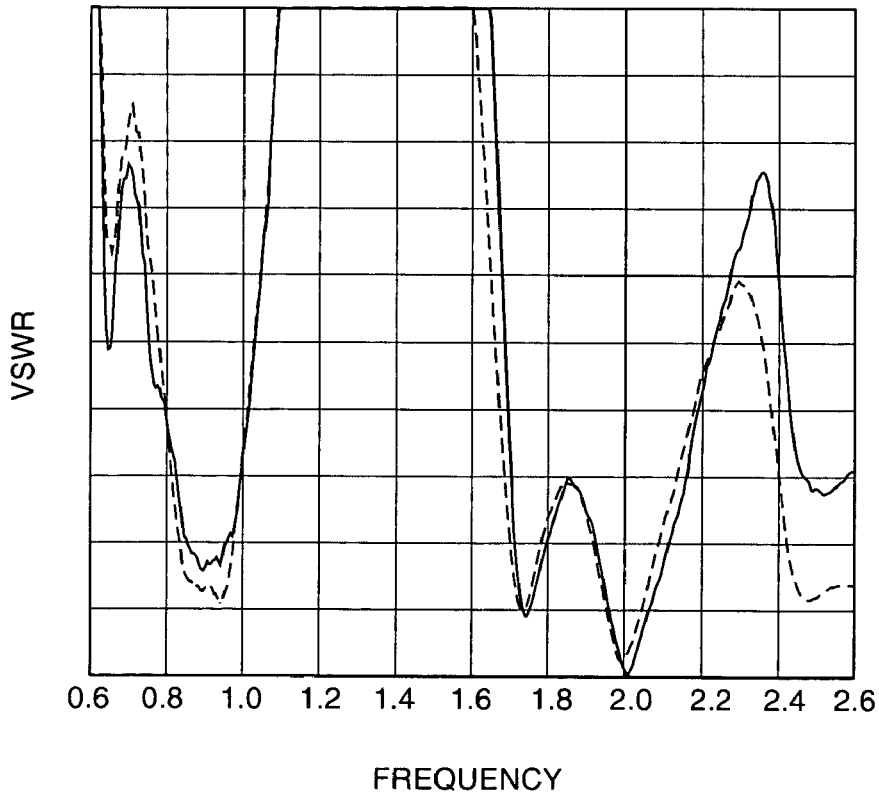
FIG. 11 illustrates the VSWR of the multi-band antenna of FIG. 5 using the matching network of FIG. 8.

FIG. 11 plots the VSWR on a rectangular coordinate system of the multi-band antenna 120 of FIG. 10 when the matching network 130 of FIG. 8 is used, where $L_1$=4.7 nH, $L_2$=22 nH, and $C_1$=0.82 pF. The solid line represents the primary antenna 126 and the parasitic antenna 128 performance without matching network 130. The dashed line represents the primary antenna 126 and the parasitic antenna 128 performance with matching network 130. A comparison of FIG. 11 with FIG. 4 shows that matching network 130 controls the impedance of multi-band antenna 120 so that the parasitic antenna 128 widens the high frequency band without significantly narrowing the low frequency band of the multi-band antenna 120.

Figure 12:
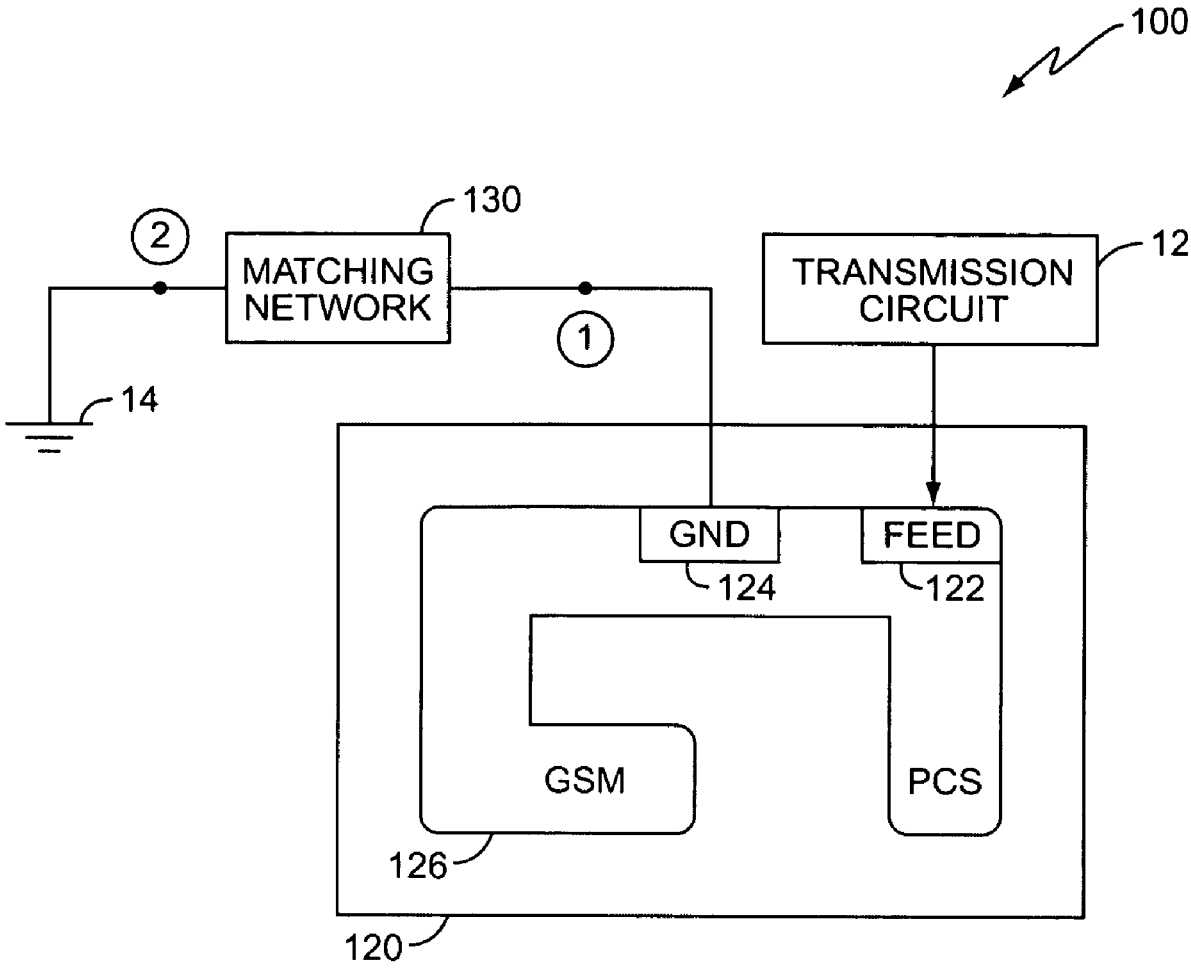
FIG. 12 illustrates another exemplary multi-band antenna with a matching network according to the present invention.

The above describes connecting a matching network 130 to a ground port 124 of a parasitic antenna 128 to control the coupling between the parasitic antenna 128 and the primary antenna 126 over a wide range of frequencies. However, the present invention is not limited to this specific embodiment. FIG. 12 illustrates another exemplary multi-band antenna system 100, where multi-band antenna 120 comprises a primary antenna 126 having a feed port 122 and at least one ground port 124. As shown in FIG. 12, matching network 130 is connected to a ground port 124 of primary antenna 126. Like the embodiment of FIG. 10, matching network 130 provides a first impedance, such as an open circuit impedance, in a first frequency band and a second impedance, such as a short circuit impedance, in a second frequency band. As a result, matching network 130 controls the operation of multi-band antenna 120 over a wide range of frequencies. This embodiment may be particularly useful when different types of antennas perform better in different frequency bands. For example, using the matching network 130 of FIG. 8, multi-band antenna 120 may operate as an inverted F-antenna (IFA) or planar inverted F-antenna (PIFA) in the first frequency band, and may operate as a monopole or bent monopole antenna in the second frequency band. In other words, by varying the impedance of the ground port 124 of multi-band antenna 120 using matching network 130, matching network 130 may alter the operation of a single antenna 126 to implement a desired antenna type for a particular frequency band.

The above describes a method and apparatus for controlling the impedance of a multi-band antenna 120 over a wide range of frequencies. To that end, most of the examples included herein describe adding a matching network 130 to a ground port 124 of a multi-band antenna 120, where the matching network 130 is configured to operate as a short circuit in one frequency band and as an open circuit in another frequency band. However, it will be appreciated that while the majority of the discussions regarding the matching network 130 of the present invention relate to open and short circuits, the present invention is not so limited. The present invention also applies to a matching network 130 configured to provide different impedances for different transmission frequency bands.

In addition, while the above discussions focus on a limited number of frequency bands and wireless standards, such as GSM, EGSM, PCS, and DCS, those skilled in the art will appreciate that the present invention is not limited to these frequency bands. Instead, the present invention applies to any specified frequency band and may be used for a wide variety of wireless communication standards.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A multi-band antenna system for a wireless terminal comprising:

a multi-band antenna having a feed port and a ground port;

a transmission circuit connected to the feed port, said transmission circuit configured to provide transmission signals to the multi-band antenna; and a matching network comprising a parallel passive circuit or a parallel active circuit connected in series to the ground port and configured to control an impedance of the multi-band antenna by implementing different antenna types for different transmission frequencies, said matching network configured to control the impedance by operating as an open circuit when the multi-band antenna operates in a first frequency band and as a short circuit when the multi-band antenna operates in a second frequency band.

2. The multi-band antenna system of claim 1 wherein the first frequency band comprises a low frequency band and wherein the second frequency band comprises a high frequency band.

3. The multi-band antenna system of claim 1 wherein the first frequency band comprises a high frequency band and wherein the second frequency band comprises a low frequency band.

4. The multi-band antenna system of claim 1 wherein the passive circuit comprises a series inductor-capacitor circuit in parallel with a capacitor or inductor.

5. The multi-band antenna system of claim 4 wherein the passive circuit comprises the series inductor-capacitor circuit in parallel with the inductor when the first frequency band comprises a low frequency band and the second frequency band comprises a high frequency band.

6. The multi-band antenna system of claim 4 wherein the passive circuit comprises the series inductor-capacitor circuit in parallel with the capacitor when the first frequency band comprises a high frequency band and the second frequency band comprises a low frequency band.

7. The multi-band antenna system of claim 1 wherein the first antenna comprises an inverted F-antenna or a planar inverted F-antenna and wherein the second antenna comprises a monopole antenna or bent monopole antenna.

8. The multi-band antenna system of claim 1 wherein the active circuit comprises:

a first circuit path;

a second circuit path; and a switching circuit to selectively connect the ground port to the first circuit path or to the second circuit path based on the current transmission frequency band.

9. The multi-band antenna system of claim 8 wherein the first circuit path comprises an open circuit path and wherein the second circuit path comprises a short circuit path.

10. The multi-band antenna system of claim 9 wherein the switching circuit selectively connects the ground port to the open circuit path when the multi-band antenna operates in a low frequency band and wherein the switching circuit selectively connects the ground port to the short circuit path when the multi-band antenna operates in a high frequency band.

11. The multi-band antenna system of claim 1 further comprising:

a second ground port; and a second matching network connected to the second ground port, wherein said second matching network is configured to further control the multi-band antenna performance based on the current transmission frequency band.

12. The multi-band antenna system of claim 1 wherein the multi-band antenna comprises:

a primary antenna including the feed port; and a parasitic antenna capacitively coupled to the primary antenna, said parasitic antenna including a parasitic ground port, wherein said matching network is connected to the parasitic ground port.

13. A method of improving an efficiency of a multi-band antenna over a wide range of frequencies, the method comprising:

connecting a matching network comprising a parallel passive circuit or a parallel active circuit in series to a ground port of the multi-band antenna to control an impedance of the muiti-band antenna based on a current transmission frequency band to implement different antenna types for different transmission frequencies; and configuring the matching network to operate as an open circuit when the multi-band antenna operates in a first frequency band and to operate as a short circuit when the multi-band antenna operates in a second frequency band.

14. The method of claim 13 wherein the first frequency band comprises a low frequency band and wherein the second frequency band comprises a high frequency band.

15. The method of claim 13 wherein the active circuit comprises a first circuit path, a second circuit path, and a switch, wherein configuring the matching network comprises selectively controlling the switch to connect the ground port to the first or second circuit paths based on the current transmission frequency band.

16. The method of claim 13 further comprising:

connecting a second matching network to a second ground port of the multi-band antenna; and configuring the second matching network to further control the impedance of the multi-band antenna based on the current transmission frequency band.

17. The method of claim 13 wherein the multi-band antenna comprises a parasitic antenna capacitively coupled to a primary antenna, wherein connecting the matching network to the ground port comprises connecting the matching network to a parasitic ground port of the parasitic antenna.

* * * * *